US009969103B2

(12) United States Patent
Yang et al.

(10) Patent No.: US 9,969,103 B2
(45) Date of Patent: May 15, 2018

(54) ENVIRONMENTAL-FRIENDLY MORTAR MIXING ROBOT

(71) Applicant: SHENZHEN WEIHAI BUILDING MATERIAL CO., LTD, Shenzhen, Guangdong (CN)

(72) Inventors: Genhong Yang, Guangdong (CN); Zhengmao Li, Guangdong (CN); Suping Xia, Guangdong (CN)

(73) Assignee: SHENZHEN WEIHAI BUILDING MATERIAL CO., LTD., Shenzhen (CN)

( * ) Notice: Subject to any disclaimer, the term of this patent is extended or adjusted under 35 U.S.C. 154(b) by 0 days. days.

(21) Appl. No.: 15/534,682

(22) PCT Filed: Dec. 25, 2014

(86) PCT No.: PCT/CN2014/094897
§ 371 (c)(1),
(2) Date: Jun. 9, 2017

(87) PCT Pub. No.: WO2016/101199
PCT Pub. Date: Jun. 30, 2016

(65) Prior Publication Data
US 2017/0341264 A1 Nov. 30, 2017

(51) Int. Cl.
*B28C 7/04* (2006.01)
*B28C 9/00* (2006.01)
(Continued)

(52) U.S. Cl.
CPC ..... *B28C 7/0084* (2013.01); *B28C 7/0061* (2013.01); *B28C 7/044* (2013.01);
(Continued)

(58) Field of Classification Search
CPC ..... B28C 7/0084; B28C 7/044; B28C 7/0418; B28C 9/02; B28C 7/128; B28C 7/0053;
(Continued)

(56) References Cited

U.S. PATENT DOCUMENTS 4,548,507 A * 10/1985 Mathis ..... B28C 9/00 366/156.2
4,792,234 A * 12/1988 Doherty ..... B28C 9/0454 366/14
(Continued)

FOREIGN PATENT DOCUMENTS

WO WO-9623639 A1 * 8/1996 ..... B28C 9/0454

*Primary Examiner* — Charles Cooley

(57) ABSTRACT

An environmental-friendly mortar robot comprises a first, second, third, and fourth container module. The first container module (2) consists of a sand midway silo, a weighing system, a stirring system, and a control system; the second container module (3) consists of a cement silo, a spiral conveying machine, a material level meter and a water storage tank; the third container module (4) consists of a fly-ash silo, a spiral conveying machine, a material level meter and an air storage tank with an air compressor; the fourth container module (5) consists of a sand storage bin, an elevator, a material level meter and an additive storage box. While transporting, the first container module can be respectively detached into four functional modules which are directly put onto a transporting vehicle together with other three container modules for transportation.

6 Claims, 5 Drawing Sheets

(51) Int. Cl.
*B28C 7/00* (2006.01)
*B28C 7/12* (2006.01)
*B28C 9/02* (2006.01)

(52) U.S. Cl.
CPC ..... *B28C 7/0418* (2013.01); *B28C 7/128* (2013.01); *B28C 9/02* (2013.01)

(58) Field of Classification Search
CPC .. B28C 7/0061; B28C 7/0069; B01F 13/1005
USPC ..... 366/18
See application file for complete search history.

(56) References Cited

U.S. PATENT DOCUMENTS 5,667,298 A * 9/1997 Musil ..... B28C 5/2018 366/17
2004/0176876 A1* 9/2004 Oberg ..... B01F 15/0479 700/265
2005/0219941 A1* 10/2005 Christenson ..... B01F 7/022 366/18
2014/0355372 A1* 12/2014 Black ..... B01F 7/00216 366/8
2017/0341264 A1* 11/2017 Yang ..... B28C 7/0084

* cited by examiner

ENVIRONMENTAL-FRIENDLY MORTAR MIXING ROBOT

TECHNICAL FIELD

The present application relates to an environmental-friendly mortar robot used in construction.

BACKGROUND

Mortar is a type of building material which is consumed a lot and which has a wide application. The mortar is also an inevitable product when construction industry develops into a certain stage. However, with the increasing demands of construction quality and environment, defects and limitations of traditional way of stirring mortar in site are more and more prominent, and thus it is difficult to meet the needs of social developments. At present, the preparation of the mortar in domestic can be divided into two ways based on the specific preparation processes: the first way is wet mixing. Mortar produced in this way is generally mixed and prepared intensively in a mixing plant, and the amount of the mortar produced in this way is large, which means the construction site needs to use up all the mortar within a specific period of time. Therefore, the mortar needs to satisfy some performances of high request such as having a long setting time, a good flowing retention ability, and the like. Since the setting time of the mortar is long, certain phenomenon, such as sagging, is likely to occur. Furthermore, the mortar produced in this way has a single variety, and most of the mortar has low capacity utilization. The second way is dry mixing. During the transportation of the dry-mixing mortar, materials will be easily to be separated from each other. After reaching to the construction site, water needs to be added into the dry-mixing mortar in order to carry out a secondary stirring before it is used, which makes the quality of the mortar unstable. A large storage space is needed for storing the mortar, and the production efficiency is low. To overcome the defects of the two production ways of the mortar, it is significant to develop a new way for producing the mortar having a stable and reliable quality, being environmental-friendly, having a simple operation, capable of being stirred whenever it is needed, occupying a small area and being transported conveniently.

Technical Problem

The objective of the present application is to provide an environmental-friendly mortar robot which is environmental-friendly, has a simple operation, can be stirred whenever it is needed, occupies a small area and can be transported conveniently, aiming at the drawbacks described above.

Technical Solution to the Problem

Technical Solution

In order to solve the technical problem described above, in accordance with one aspect of the present application, an environmental-friendly mortar robot is provided, which is formed by assembling four container modules in the shape of cuboids together; the four container modules including a first container module, a second container module, a third container module and a fourth container module; the third container module being adjacent to the second container module, while the fourth container module being adjacent to the first container module.

Wherein the second container module includes a cement silo, a spiral conveying machine for cement, a material level meter for cement and a water storage tank; the spiral conveying machine for cement is located on an inner side of the cement silo, and the water storage tank is located below the cement silo; one flow-aiding device and one additional water storage tank are provided below the second container module; the water storage tank is in the shape of a cuboid;

The third container module includes a fly-ash silo, a fly-ash spiral conveying machine, a material level meter for fly-ash and a compressed air storage tank; the fly-ash spiral conveying machine is located on an inner side of fly-ash silo, and the fly-ash compressed air storage tank is located below the fly-ash silo; an air compressor system, a flow-aiding system and an additional material level meter are further provided inside the third container module; the air compressor system is respectively communicated with a powder bin, an aggregate bin, a flow-aiding device of an aggregate weighing hopper or a flow-aiding device of a powder weighing hopper;

The fourth container module includes a sand storage silo, an elevator, a material level meter, a flow-aiding device and an additive storage box; the elevator is located on an outer side of the sand storage silo, and configured for conveying sand in the sand storage silo to an interim silo; the flow-aiding device is located at a bottom of the sand storage silo, and configured for ensuring a continuity conveying of the sand; the additive storage box is located below the sand storage silo; the material level meter is configured for monitoring the remaining material of the silo;

Wherein the first container module includes a sand midway silo, a weighing system, a stirring system, a controlling system and a discharging system; the sand midway silo, the weighing system, the stirring system, the controlling system and the discharging system are arranged in four functional modules stacked on another; wherein the sand midway silo is located in a top functional module; the weighing system is located in the functional module below the sand midway silo; the stirring system is located in the functional module below the weighing system; the controlling system and the discharging system are both located in the functional module below the stirring system.

In the environmental-friendly mortar robot of the present application, the sand midway silo includes a sand interim frame and an interim silo mounted inside the sand interim frame; a material level controlling system is mounted on a top of the interim silo; the interim silo includes a sand silo body, an elevator system mounted on one side of the sand silo body, a flow-aiding device mounted in the sand silo body, and a controlling valve accessory mounted at a discharging outlet at the bottom of the sand silo body; at least one material level meter, a silo butterfly valve, a dust recycling pipe, a silo roof pressure valve and a feeding pipe are mounted in the interim silo; the silo roof pressure valve and an upper material level meter are provided at the top of the silo butterfly valve; a flow-aiding device is located at a lower part of the silo butterfly valve; an upper end of the dust recycling pipe and an upper end of the feeding pipe are connected to the top of the silo; a bottom of the silo butterfly valve is fixedly arranged on a silo bearing plate.

In the environmental-friendly mortar robot of the present application, the weighing system includes a weighing welded platform support, a sand weighing hopper, a powder weighing hopper, an additive weighing hopper, and a water weighing hopper; wherein the sand weighing hopper, the powder weighing hopper, the additive weighing hopper and the water weighing hopper are all mounted inside the weighing welded platform support; the sand weighing hopper is mounted on one side of the weighing welded platform support, and the powder weighing hopper is mounted on the other side of the sand weighing hopper; the additive weighing hopper is located above the water weighing hopper; the sand weighing system, the powder weighing system and the water weighing system are equipped with a pressure sensor; the additive weighing system is equipped with a tension sensor having a high accuracy; an additive weighing hopper silo includes a sand silo and a weighed powder silo; the sand weighing hopper includes an aggregate weighing hopper, a powder weighing hopper, a water weighing hopper, an additive weighing hopper, an aggregate discharging butterfly valve or a powder discharging butterfly valve, a liquid feeding valve, a liquid discharging valve, a weighing hopper supporting plate, a weighing sensor, and a hopper discharging pipe; the water weighing hopper is connected to the additive weighing hopper, and is located below the additive weighing hopper; the aggregate discharging butterfly valve or the powder discharging butterfly valve is arranged on the hopper discharging pipe, and is located below the water weighing hopper; the aggregate weighing hopper or the powder weighing hopper is fixedly connected to the weighing hopper supporting plate respectively; the weighing sensor is arranged on a weighing system bearing plate, and the weighing hopper supporting plate is arranged on the weighing sensor; the weighing hopper discharging pipe is connected to a bottom of the water weighing hopper; the aggregate weighing hopper or the powder weighing hopper is communicated with the silo via the dust recycling pipe.

In the environmental-friendly mortar robot of the present application, the stirring system includes a fixing bracket ladder mounted on a stirring platform, a stirring machine mounted inside the fixing bracket ladder, and a stirring dust collector mounted on the stirring machine.

In the environmental-friendly mortar robot of the present application, the discharging outlet system includes a discharging welded platform support, a discharging chute mounted inside the discharging welded platform support, and an operating room mounted on a back of the discharging chute.

In the environmental-friendly mortar robot of the present application, the third container module is further provided with an air compressor system for fly-ash, a fly-ash damping system, a fly-ash water supplying system, and a fly-ash supplying system; the air compressor system for fly-ash includes an air compressor for fly-ash, a fly-ash storage tank, an air filter for fly-ash, an air pressure regulator for fly-ash, a plurality of pipes and connectors; the air compressor system for fly-ash is respectively communicated with the fly-ash silo, the fly-ash aggregate weighing hopper or the fly-ash powder weighing hopper, and a flow-aiding device of the fly-ash silo; the fly-ash damping system includes a damping base, a damping spring or a damping rubber, and a base connection; the water supply system includes a hydraulic pump, a water tank, and water pipes; the additive supply system includes a hydraulic pump, an additive box, and a reserve tank; the water supply system and the additive supply system are both communicated with the water weighing hopper via the liquid feeding valve.

Advantageous Effect of Present Application

Advantageous Effect

The advantageous effects of the present application include: the first container module is formed by the sand interim silo, the material level controlling system, the weighing system, the controlling system and the stirring system located in four functional modules stacked on another. The second container module, the third container module and the fourth container module adopts a modular design solution. Therefore, during the mounting process, the robot of the present application may be used only by assembling the modules described above. During the conveying process, the modules described above may be disassembled from each other and directly put on a special transporting vehicle for transportation. Therefore, the assembly or disassembly of the robot of the present application is simple. Furthermore, since the fly-ash, the sand, and the cement are stirred and mixed with each other based on a preset proportion, by using the sand elevator to convey the sand to the interim silo in the top functional module of the first container module, and by using the material level sensor mounted in the interim silo to control the material level to ensure that enough quantity of sand for stirring in one plate of mortar may be always kept in the interim silo, the weighing time of the sand may be shortened and the production continuity may be ensured, and the production efficiency may be thereby improved. Compared with the traditional production mode, the present application is environmental-friendly and highly integrated; the disassembly and assembly thereof are simple and convenient, and the operation is simple. Besides, the robot of the present application occupies a small area and is highly automated. Furthermore, the mortar robot of the present application may stir the mortar whenever the mortar is need according to the production demand, and can produce different types of mortar.

BRIEF DESCRIPTION OF THE DRAWINGS

Description of the Drawings

The technical solution of the present application will be further described with reference to the accompanying drawings and embodiments.

Figure 1:
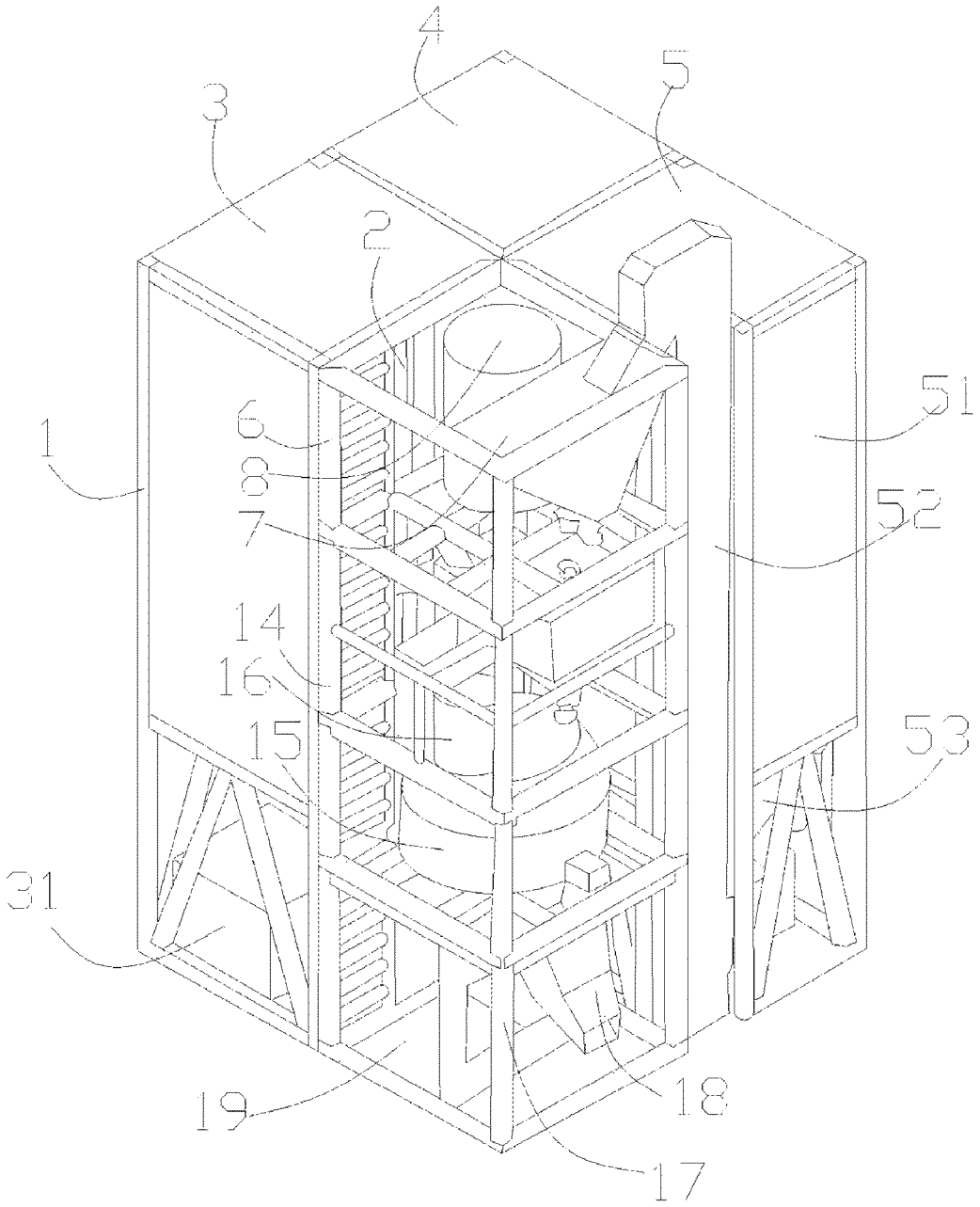

FIG. 1 is a stereogram in accordance with an environmental-friendly mortar robot of the present application.

Figure 2:
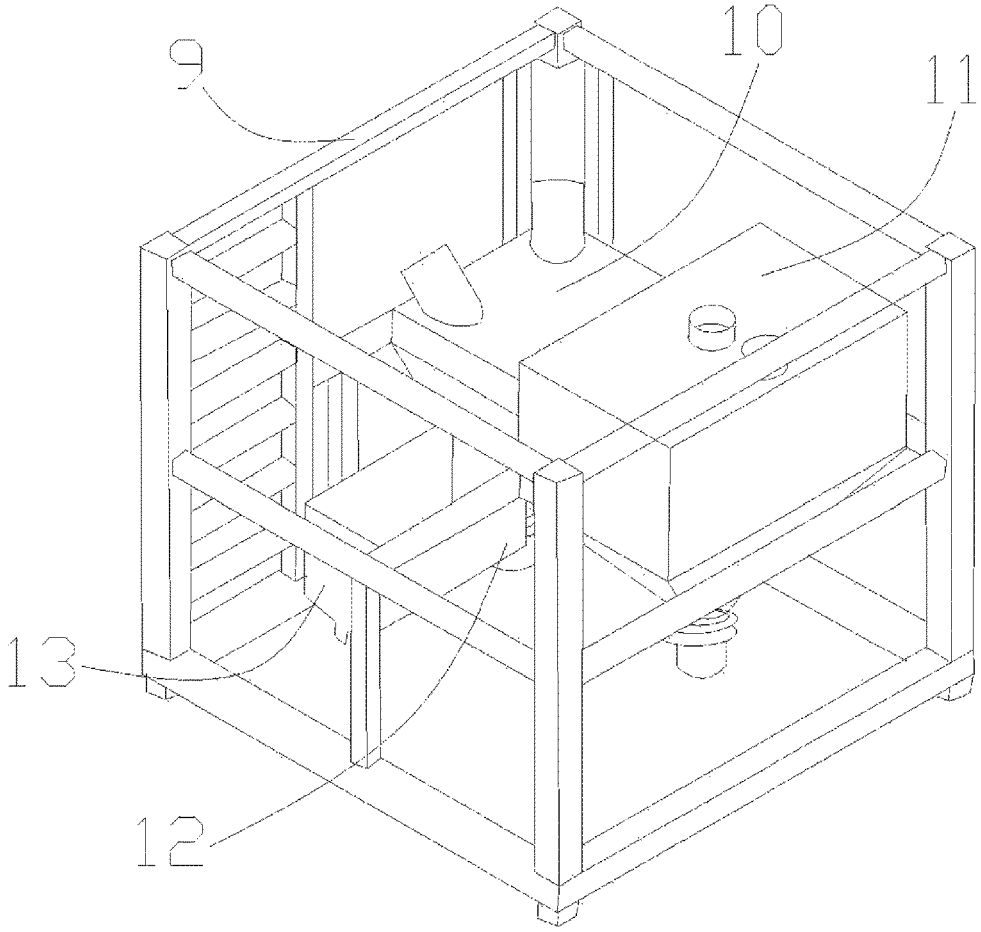

FIG. 2 is a stereogram of a material level controlling system of a sand interim silo in accordance with the present application.

Figure 3:
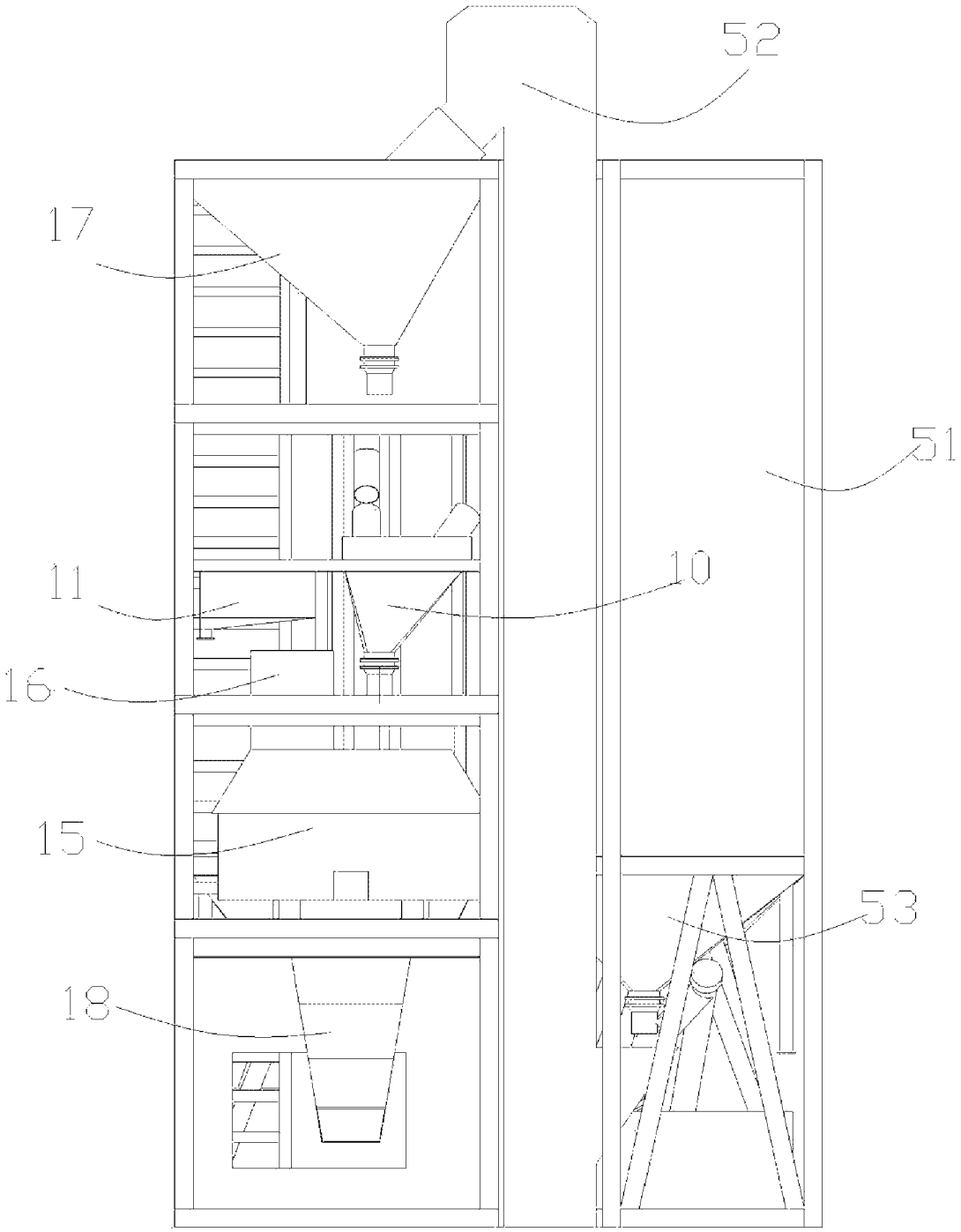

FIG. 3 is a schematic view in accordance with the environmental-friendly mortar robot of the present application.

Figure 4:
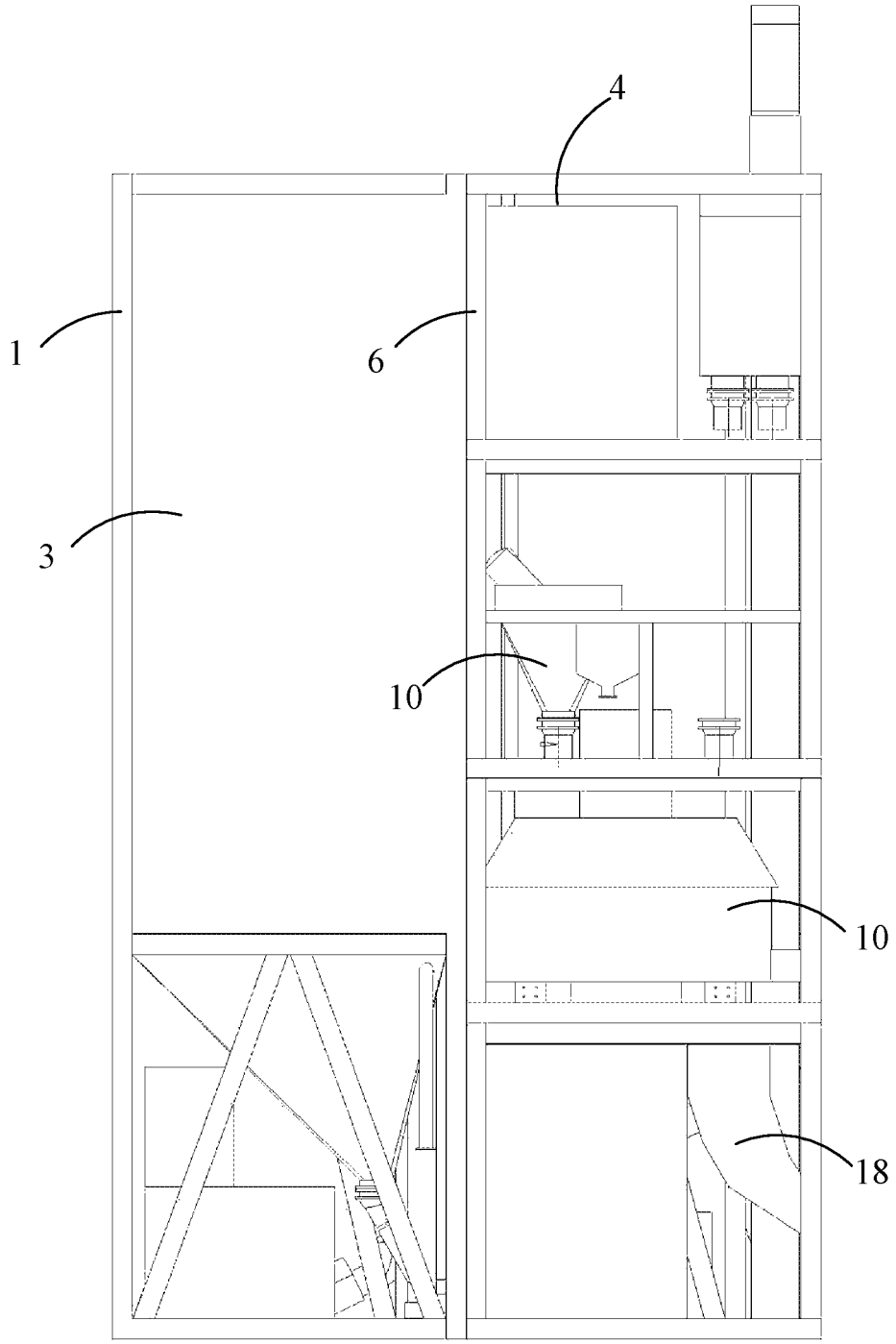

FIG. 4 is a side view in accordance with the environmental-friendly mortar robot of the present application.

Figure 5:
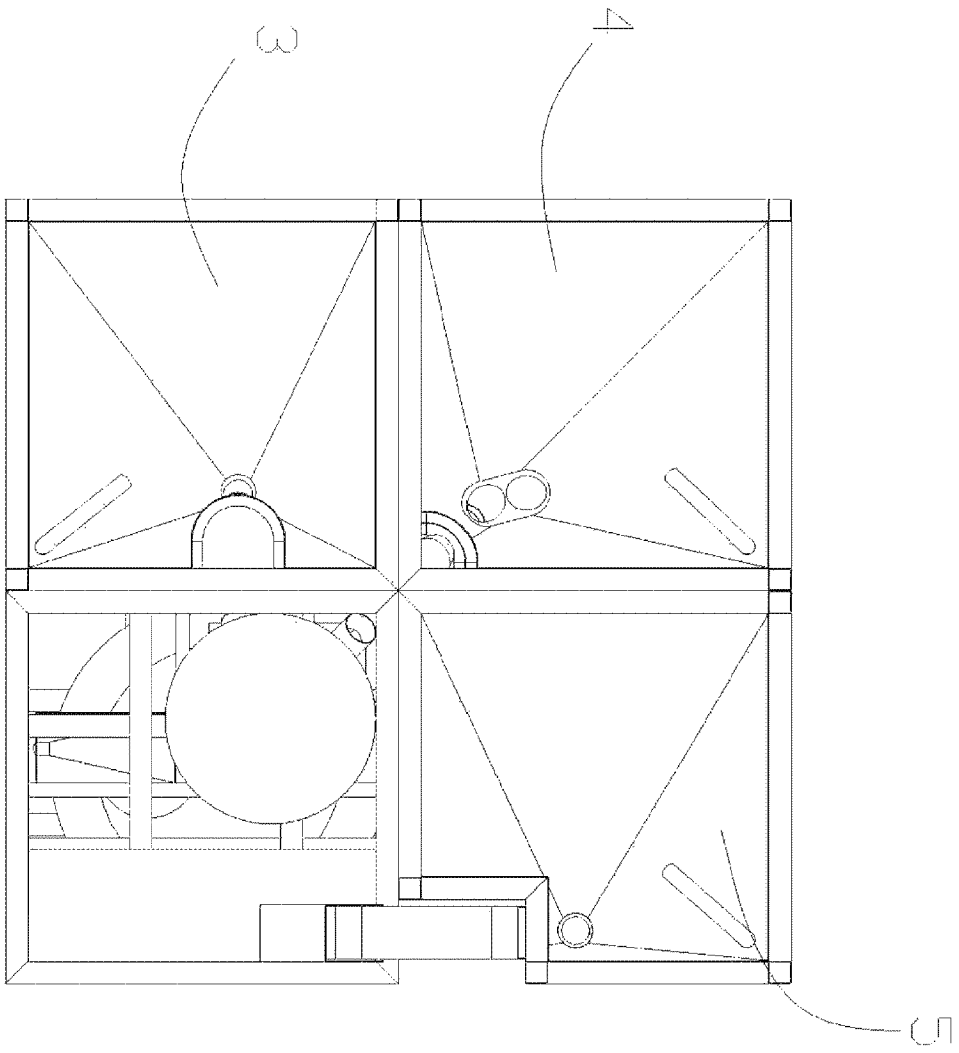

FIG. 5 is a further side view in accordance with the environmental-friendly mortar robot of the present application.

EMBODIMENT

Implemention Method

An environmental-friendly mortar robot of the present application will be described with reference to embodiments. As is shown in FIGS. 1-5, the environmental-friendly mortar robot of the present application comprises a mortar bracket 1, a first container module 2, a second container module 3, a third container module 4, and a fourth container module 5; wherein the first container module 2, the second container module 3, the third container module 4, and the fourth container module 5 are respectively mounted on the mortar bracket 1.

The second container module 3 includes a cement silo, a spiral conveying machine for cement, a material level meter for cement and a water storage tank 31. In this case, the spiral conveying machine for cement is located on an inner side of the cement silo, while the water storage tank 31 is located below the cement silo. One additional flow-aiding device and one additional water storage tank 31 are further provided below the second container module 3. The water storage tank 31 is in the shape of a cuboid.

The third container module 4 includes a fly-ash silo, a spiral conveying machine for fly-ash, a material level meter for fly-ash and a compressed air storage tank. In this case, the spiral conveying machine for fly-ash is located on an inner side of fly-ash silo, while the compressed air storage tank is located below the fly-ash silo. An air compressor system, a flow-aiding system and an additional material level meter are further provided inside the third container module 4. The air compressor system is respectively communicated with a powder bin, an aggregate bin, a flow-aiding device of an aggregate weighing hopper or a flow-aiding device of a powder weighing hopper. A damping system for a weighing platform includes a damping base, a damping spring or a damping rubber, and a base connection. A water supply system comprises a hydraulic pump, a water tank, and an additive box. An additive supply system also comprises a hydraulic pump, a water tank, and an additive box. The water supply system and the additive supply system are both communicated with a water weighing hopper via a liquid feeding valve.

The fourth container module 5 includes a sand storage silo 51, an elevator system 52, a material level meter for sand and an additive storage box 53. In this case, the elevator 52 is located at an outer side of the sand storage silo 51, while the additive storage box 53 is located below the sand storage silo 51. An additional material level meter, a flow-aiding device and a sand feeding inlet are further provided in the fourth container module 5. The powder silo is formed by a cuboid main body and a first blanking hole in the shape of a cone, and a volume of the powder silo ranges from 40 $m^3$ to 45 $m^3$. The sand storage silo 51 is formed by a cuboid main body and a second blanking hole in the shape of a cone, and a volume of the sand storage silo 51 ranges from 40 $m^3$ to 45 $m^3$. The additive storage box is in the shape of a cuboid.

The first container module 2 includes a sand interim silo system, a material level controlling system, a weighing system, a stirring system, a discharging system, and the like. In this case, the first container module 2 is formed by four functional modules stacked one another successively, and the sand interim silo system is located in a top functional module of the first container module 2. The weighing system is located in the functional module below the sand interim silo system, the stirring system is located in the functional module below the weighing system, and the controlling system and the discharging system are both located in the functional module below the stirring system.

The sand interim silo system includes a sand interim frame 6, an interim silo 7 mounted inside the sand interim frame 6, and a dust collector 8 mounted on one side of the interim silo 7. The interim silo 7 includes an interim silo shelf. The elevator is mounted on the shelf, and one discharging outlet of the elevator is connected to the interim silo 7. Furthermore, the sand container have at least one material level meter, a flow-aiding device, a silo butterfly valve, a dust recycling pipe, a silo roof pressure valve and a feeding pipe provided therein. An upper material level meter and a silo roof pressure valve are provided at the top of the silo butterfly valve, and the flow-aiding device is located at a lower part of the silo butterfly valve. An upper end of the dust recycling pipe and an upper end of the feeding pipe are connected to the roof of the silo. A bottom of the silo butterfly valve is fixedly arranged on a silo bearing plate.

The weighing system includes a weighing welded platform support 9, a powder weighing hopper 10, a sand weighing hopper 11, an additive weighing hopper 12, and a water weighing hopper 13; wherein the powder weighing hopper 10, the sand weighing hopper 11, the additive weighing hopper 12 and the water weighing hopper 13 are all mounted inside the weighing welded platform support 9. The powder weighing hopper 10 is mounted at an upper end on one side of the weighing welded platform support 9. The sand weighing hopper 11 is mounted on one side of the powder weighing hopper 10. The additive weighing hopper 12 is mounted on another side of the powder weighing hopper 10 and the sand weighing hopper 11. The additive weighing hopper 12 is located above the water weighing hopper 12. After being weighed, the additive enters the water weighing hopper, mixes with the water, and finally enters the stirring machine. The aggregate weighing system, the powder weighing system, and the water weighing system may be equipped with a pressure sensor. In this case, the additive weighing system is equipped with a tension sensor having a high accuracy. The sand weighing hopper may include an aggregate weighing hopper or a powder weighing hopper, a water weighing hopper, an additive weighing hopper, an aggregate discharging butterfly valve or a powder discharging butterfly valve, a liquid feeding valve, a liquid discharging valve, a weighing hopper supporting plate, a weighing sensor, a weighing transmitter, and a hopper discharging pipe. The aggregate weighing hopper or the powder weighing hopper is fixedly connected to the weighing hopper supporting plate respectively. The weighing sensor is arranged on the weighing system bearing plate. The weighing hopper supporting plate is arranged on the weighing sensor. The weighing hopper discharging pipe is connected to a bottom of the water weighing hopper 12. The aggregate weighing hopper or the powder weighing hopper is communicated with the silo via the dust recycling pipe.

The stirring system includes a stirring fixing bracket ladder 14 connected to the weighing platform and located below the weighing platform, a stirring machine 15 mounted inside the stirring fixing bracket ladder 14, and a stirring dust collector 16 mounted on the stirring machine 15. The discharging system includes a discharging welded platform support 17, a discharging chute 18 mounted inside the discharging welded platform support 17, and an operating room 19 mounted on a back of the discharging chute 18.

The third container module 4 and the fourth container module 5 are respectively arranged adjacent to the first container module 2. The second container module 3 includes the cement silo, the spiral conveying machine for cement, the material level meter for cement and the water storage tank 31. In this case, the spiral conveying machine for cement is located on an inner side of the cement bin, while the water storage tank 31 is located below the cement bin.

To simplify the structure of the present application, the weighing of all powders is integrated, and uses a common weighing hopper. The aggregate weighing hopper is configured for weighing the aggregate (sand), the powder weighing hopper is configured for weighing the powder (such as cement and fly-ash), and the water weighing hopper 12 is configured for weighing the water and the additive. The weighing hopper is in the shape of a cone, and the material flows from the outlet at the bottom of the weighing hopper to the stirring machine 15 after the weighing is finished. The stirring system is located above the stirring machine bearing plate, and a damping base is arranged between the stirring machine 15 and the stirring machine bearing plate, in order to reduce the impact of vibrations on other systems. An auxiliary system includes an air compressor system, a damping system, a flow-aiding system, a water supplying system, a printing system and the like. The controlling system substantially includes a PLC controlling unit, a touch screen, an analog-digital conversion module, a weighing sensor, and a plurality of actuating elements. The PLC controlling unit has the features of having a high stability, a strong control ability, and the like. The sensor includes the weighing sensor, and an upper material level meter and a lower material level meter of the silo. The plurality of actuating elements include a silo discharging butterfly valve, a weighing hopper discharging butterfly valve, a sulphurator of the silo and the weighing hopper, two pumps (respectively for supplying water and water-based additive), a water supply valve, an additive valve, a motor of the stirring machine, a discharging valve of the stirring machine, and the like.

In conclusion, the first container module 2 of the present application includes four functional modules respectively configured for holding the sand interim silo, the weighing system, the stirring system and the discharging system, and the like. The second container module 3, the third container module 4 and the fourth container module 5 adopts a modular design solution. Therefore, during the mounting process, the robot of the present application may be used only by assembling the modules described above. During the conveying process, the modules described above may be disassembled from each other and conveyed individually. Therefore, the assembly or disassembly of the robot of the present application is simple. Furthermore, since the fly-ash, the sand, and the cement are stirred and mixed with each other based on a preset proportion, by using the sand elevator to convey the sand to the interim silo in the top functional module of the first container module 2, and by using the material level sensor mounted in the interim silo to control the material level, the weighing time of the sand may be shortened and the production continuity may be ensured, and the production efficiency may be thereby improved. Compared with the traditional production mode, the present application is environmental-friendly and highly integrated; the disassembly and assembly thereof are simple and convenient, and the operation is simple. Besides, the robot of the present application occupies a small area and is highly automated. Furthermore, the mortar robot of the present application may stir the mortar whenever the mortar is need according to the production demand, and can produce different types of mortar.

The invention claimed is:

1. An environmental-friendly mortar robot, formed by assembling four container modules in the shape of cuboids together; the four container modules including a first container module, a second container module, a third container module and a fourth container module; the third container module being adjacent to the second container module, while the fourth container module being adjacent to the first container module;

wherein the second container module includes a cement silo, a spiral conveying machine for cement, a cement level meter and a water storage tank; the spiral conveying machine for cement is located on an inner side of the cement silo, and the water storage tank is located below the cement silo; one cement flow-aiding device and one additional water storage tank are provided below the second container module; the water storage tank is in the shape of a cuboid;

the third container module includes a fly-ash silo, a spiral conveying machine for fly-ash, a fly-ash level meter and a compressed air storage tank; the spiral conveying machine for fly-ash is located on an inner side of the fly-ash silo, and the compressed air storage tank is located below the fly-ash silo; an air compressor system, a fly-ash flow-aiding device and an additional fly-ash level meter are further provided inside the third container module; the air compressor system is respectively communicated with a powder bin, an aggregate bin, an aggregate weighing hopper or a powder weighing hopper, and the fly-ash flow-aiding device;

the fourth container module includes a sand storage silo, an elevator, a sand level meter, a first sand flow-aiding device and a first additive storage box; the elevator is located on an outer side of the sand storage silo, and configured for conveying sand in the sand storage silo to an interim silo; the first sand flow-aiding device is located at a bottom of the sand storage silo, and configured for ensuring a continuity conveying of the sand; the first additive storage box is located below the sand storage silo; the sand level meter is configured for monitoring the sand remained in the sand storage silo;

wherein the first container module includes a sand interim silo system, a weighing system, a stirring system, a controlling system and a discharging system; the sand interim silo system, the weighing system, the stirring system, the controlling system and the discharging system are arranged in four functional modules stacked on another; wherein the sand interim silo system is located in a top functional module; the weighing system is located in the functional module below the sand interim silo system; the stirring system is located in the functional module below the weighing system; the controlling system and the discharging system are both located in the functional module below the stirring system.

2. The environmental-friendly mortar robot of claim 1, wherein the sand interim silo system includes a sand interim frame and the interim silo mounted inside the sand interim frame; a sand level controlling system is mounted on a top of the interim silo; the interim silo includes a sand silo body, an elevator system mounted on one side of the sand silo body, a second sand flow-aiding device mounted in the sand silo body, and a controlling valve accessory mounted at a discharging outlet at the bottom of the sand silo body; at least one sand level meter, a silo butterfly valve, a dust recycling pipe, a silo roof pressure valve and a feeding pipe are mounted in the interim silo; the silo roof pressure valve and an upper sand level meter are provided at the top of the silo butterfly valve; the second sand flow-aiding device is located at a lower part of the silo butterfly valve; an upper end of the dust recycling pipe and an upper end of the feeding pipe are connected to the top of the sand silo body; the bottom of the silo butterfly valve is fixedly arranged on a silo bearing plate.

3. The environmental-friendly mortar robot of claim 1, wherein the weighing system includes a weighing welded platform support, a powder weighing hopper, a sand weighing hopper, an additive weighing hopper, and a water weighing hopper; wherein the powder weighing hopper, the sand weighing hopper, the additive weighing hopper and the water weighing hopper are all mounted inside the weighing welded platform support; the sand weighing hopper is mounted on one side of the weighing welded platform support, and the powder weighing hopper is mounted on the other side of the sand weighing hopper; the additive weighing hopper is located above the water weighing hopper; the aggregate weighing system, the powder weighing system and the water weighing system are equipped with a pressure sensor; the additive weighing system is equipped with a tension sensor; the additive weighing hopper includes a sand silo and a weighed powder silo; the sand weighing hopper includes an aggregate weighing hopper, a powder weighing hopper, a water weighing hopper, an additive weighing hopper, an aggregate discharging butterfly valve or a powder discharging butterfly valve, a liquid feeding valve, a liquid discharging valve, a weighing hopper supporting plate, a weighing sensor, and a hopper discharging pipe; the water weighing hopper is connected to the additive weighing hopper, and is located below the additive weighing hopper; the aggregate discharging butterfly valve or the powder discharging butterfly valve is arranged on the hopper discharging pipe, and is located below the water weighing hopper; the aggregate weighing hopper or the powder weighing hopper is respectively and fixedly connected to the weighing hopper supporting plate; the weighing sensor is arranged on a weighing system bearing plate, and the weighing hopper supporting plate is arranged on the weighing sensor; the weighing hopper discharging pipe is connected to a bottom of the water weighing hopper; the aggregate weighing hopper or the powder weighing hopper is communicated with the sand silo via the dust recycling pipe.

4. The environmental-friendly mortar robot of claim 1, wherein the stirring system includes a fixing bracket ladder mounted on a stirring platform, a stirring machine mounted inside the fixing bracket ladder, and a stirring dust collector mounted on the stirring machine.

5. The environmental-friendly mortar robot of claim 1, wherein the discharging system includes a discharging welded platform support, a discharging chute mounted inside the discharging welded platform support, and an operating room mounted on a back of the discharging chute.

6. The environmental-friendly mortar robot of claim 1, wherein the third container module is further provided with an air compressor system for fly-ash, a fly-ash damping system, a fly-ash water supplying system, a fly-ash supplying system, and an additive supply system; the air compressor system for fly-ash includes an air compressor for fly-ash, a fly-ash storage tank, an air filter for fly-ash, an air pressure regulator for fly-ash, a plurality of pipes and connectors; the air compressor system for fly-ash is respectively communicated with the fly-ash silo, the fly-ash aggregate weighing hopper or the fly-ash powder weighing hopper, and the fly-ash flow-aiding device; the fly-ash damping system includes a damping base, a damping spring or a damping rubber, and a base connection; the water supply system includes a hydraulic pump, a water tank, and water pipes; the additive supply system includes a hydraulic pump, a second additive storage box, and a reserve tank; the water supply system and the additive supply system are both communicated with the water weighing hopper via a liquid feeding valve.

* * * * *